US006509693B2

(12) United States Patent
Yonezawa et al.

(10) Patent No.: US 6,509,693 B2
(45) Date of Patent: Jan. 21, 2003

(54) FILAMENT FOR FLUORESCENT DISPLAY DEVICE

(75) Inventors: Yoshihisa Yonezawa, Mobara (JP); Yukio Ogawa, Mobara (JP); Kazuyoshi Ishikawa, Mobara (JP); Katsutoshi Kogo, Mobara (JP); Satoshi Yoshimura, Mobara (JP)

(73) Assignee: Futaba Corporation, Mobara (JP)

( * ) Notice: Subject to any disclaimer, the term of this patent is extended or adjusted under 35 U.S.C. 154(b) by 0 days.

(21) Appl. No.: 09/928,407

(22) Filed: Aug. 14, 2001

(65) Prior Publication Data

US 2002/0047573 A1 Apr. 25, 2002

(30) Foreign Application Priority Data

Sep. 6, 2000 (JP) ..... 2000-270290

(51) Int. Cl.[7] ..... G09G 3/10

(52) U.S. Cl. ..... 315/169.3; 174/113 C; 174/171

(58) Field of Search ..... 315/169.3; 174/113 C, 174/110 R, 158 R, 168, 171

(56) References Cited

U.S. PATENT DOCUMENTS 4,799,518 A * 1/1989 Haug ..... 140/71.5
5,015,197 A * 5/1991 Redmond et al. ..... 439/329

* cited by examiner

*Primary Examiner*—Don Wong
*Assistant Examiner*—Thuy Vinh Tran

(57) ABSTRACT

A filament core wire capable of being mounted while having tension at a predetermined level applied thereto without an expensive anchor and without applying unnecessary tension thereto. The filament core wire is provided at a part thereof with spring and welded sections. The sections each are covered with a heat-decomposable block element made of acrylic resin or the like. Also, the core wire has a carbonate deposited thereon. The core wire is mounted on a mounting position by removing the block element from the welded section of the wire arranged on the fixing position by heating and then welding the welded section to a fixing spot of the fixing position. Then, block element is removed from the spring section by heating. This permits the filament core wire to be stretchedly arranged at the mounting position while keeping tension applied to the core wire to provide it with elasticity.

5 Claims, 7 Drawing Sheets

FILAMENT FOR FLUORESCENT DISPLAY DEVICE

BACKGROUND OF THE INVENTION

This invention relates to a core wire for a filament adapted to be heated for driving to emit electrons therefrom, such a filament and a method for mounting such a filament. Also, the present invention relates to a fluorescent display device for carrying out desired display due to impingement of electrons on phosphors and a method for manufacturing such a fluorescent display device. The fluorescent display devices include a write head for carrying out desired optical writing on a photosensitive element due to impingement of electrons emitted from a filament thereon.

Now, a conventional fluorescent display device of such a type as described above which has been generally known in the art will be described with reference to FIGS. 6 and 7, wherein FIG. 6 is a partially cutaway perspective view generally showing a structure of the fluorescent display device and FIG. 7 is a partially enlarged sectional view of the fluorescent display device of FIG. 6 which is taken in a direction in which filaments are arranged stretchedly or while being stretched.

The conventional fluorescent display device generally designated at reference numeral 31 in FIGS. 6 and 7, as shown in FIG. 6, includes a box-like envelope 32 of which an interior is kept at a high vacuum. The envelope 32 includes a box-like casing 36 which is constituted by an anode substrate 33 made of an insulating material, a front cover 34 made of an insulating and light-permeable material and a frame-like side plate 35 made of an insulating material.

The anode substrate 33, as shown in FIG. 7, is formed on an inner surface thereof positioned in the envelope 32 with a wiring layer (wiring conductor) 37 in a predetermined pattern depending on a display pattern 38. The wiring layer 37 may be made of, for example, an thin Al film. The wiring layer 37 is formed thereon with an insulating layer 39 laminatedly or by lamination. The insulating layer 39 is formed at portions thereof corresponding to display segments 40 of the display pattern 38 with through-holes 41, via which the wiring layer 37 is exposed. The through-holes 41 with which the wiring layer 37 is exposed each are filled therein with a conductive layer 42 by printing of a conductive paste.

The insulating layer 39, as shown in FIG. 7, is formed on a surface thereof facing the front cover 34 with anode conductors 43 in a discrete manner in correspondence to the display segments 40 of the display pattern 38 so as to be electrically connected to the wiring layer 37 through the conductive layers 42. The anode conductors 43 may be formed of a thick film by printing. The thick film may be made of, for example, either a graphite paste constituted by a graphite powder and an organic binder or an Al paste. This provides anodes 45 each for every display segments 40 of the display pattern 38.

Above the anodes 45, as shown in FIGS. 6 and 7, are arranged mesh-like grids 46, above which cathodes 47 each constituted by a filament are arranged stretchedly or while being stretched.

The filament for each of the cathodes 47 arranged in the fluorescent display device 31 is made by coating carbonate of Ba, Sr or Ca on a tungsten core wire of from several microns to tens of microns in diameter. In order to permit each of the filaments to emit thermions, it is required to feed the tungsten with electricity to heat the filament to a temperature within a range of between 600° C. and 650° C. For example, heating of the filament of, for example, 10 mm in length to a temperature of 650° C. supposing that it is at a room temperature (24° C.) during non-heating causes the filament to elongate by about 0.3 mm because tungsten has a thermal expansion coefficient of $4.4\times10^{-7}$. Such elongation of the filament by about 0.3 mm causes sagging of the filament, resulting in the filament contacting with the anodes 45 and grids 46 in the envelope 32, leading to a failure in insulation. Also, such sagging of the filament causes vibration of the filament when the fluorescent display device is of the vehicle-mounted type or the like, to thereby adversely affect display of the fluorescent display device. More particularly, vibration of the filament acting as an electron emitting source causes display of the fluorescent display device to be vibrated in synchronism therewith, leading to flickering of the display, to thereby deteriorate visibility of the display.

In order to eliminate the above-described problem, the conventional fluorescent display device 31 is provided with a support structure for fixing each of the filaments while applying tension of a predetermined magnitude to the filament, to thereby prevent sagging of the filament due to thermal expansion thereof. The support structure is constituted by a support 51 acting as a stationary stretching member for fixing one end of each of the filaments and an anchor 52 acting as an elastic stretching member for elastically holding the other end of each of the filaments. This permits each of the filaments to be fixed at one end thereof on the support 51 and elastically held at the other end thereof on the anchor 52, so that the filament may be elastically arranged between the support 51 and the anchor while being stretched therebetween.

Also, in place of the anchor 52 for elastically holding the filament, a structure which includes a coiled filament constituted by a coiled tungsten core wire formed at at least a part thereof with a coiled portion and a carbonate material electro-deposited on the coiled tungsten core wire, to thereby exhibit elasticity is known in the art. Such a coiled filament may be made as shown in FIG. 8. More specifically, the coiled tungsten core wires each are fixed on a metal frame 62 while keeping a coiled portion 61*a* thereof stretched and then the metal frame 62 is placed in an electrolytic bath 64 in which an electrolytic carbonate solution 63 is filled. Then, a voltage at a predetermined level such as, for example, 60V is applied between the metal frame 62 and the bath 64 for a predetermined period of time (for example, 60 seconds). This permits the carbonate to be electro-deposited on the coiled tungsten core wires, resulting in coiled filaments 61 being provided. Then, the coiled filaments 61 thus provided each are welded to a metal member for fixing the filament.

Unfortunately, the above-described approaches each have a disadvantage. More particularly, the elastic anchor 52 of FIG. 7 for absorbing sagging of the filament is expensive because it is required to subject a material for the anchor to etching and pressing. Also, manufacturing of the anchor 52 requires a holding plate for forming the anchor 52 into a frame-like shape. The holding plate must be formed into a thickness as large as 0.2 to 0.3 mm in order to overcome tension of the filament. Such an increased thickness causes the holding plate to be unsuitable for incorporation in an ultrathin fluorescent display device in which a distance between two substrates is as small as about 1 mm.

For example, use of a substrate material (for each of the anode substrate, front cover, side plate and the like) for the purpose of realizing an ultrathin fluorescent display device which has never been seen in the art causes a size of a package which permits the substrate to satisfactorily exhibit pressure resistance to be subjected to a restriction. Thus, it is required to arrange struts in the envelope. Also, the ultrathin fluorescent display device in which such thin substrates are arranged causes even a difference in level due to a thickness of the metal frame to apply stress to each of the substrates, leading to likelihood that a portion of the substrate through which the metal frame is led out cracks. Thus, it is required that the side plate is recessed at a portion thereof corresponding to a position of the flourescent display device of which the metal frame is led out by a depth corresponding to a thickness of the metal frame by chipping or the like.

The above-described coiled filaments 61 shown in FIG. 8 are made by fixing the plural coiled tungsten core wires in the metal frame 62 and then electro-depositing the carbonate on the core wires. This requires that the electro-deposition is carried out by batch processing for every metal frame 62 rather than continuous processing, leading to a failure in automation of manufacturing of the filaments. Also, welding of the filaments must be carried out for every filament after they are removed from the metal frame 62, to thereby further keep the manufacturing from being automated.

Further, in manufacturing of the coiled filaments 61, it is required to stretchedly arrange each of the coiled tungsten core wires while keeping the coiled portion 61*a* elongated in order to ensure application of tension at a predetermined level thereto.

Moreover, the welding is carried out with respect to the coiled tungsten core wire having the carbonate electro-deposited all over a surface thereof. Thus, the welding causes scattering of the carbonate in the envelope of the fluorescent display device, resulting in pollution therein, leading to a reduction in vacuum in the envelope or fluorescent display device. In addition, intrusion of the scattered carbonate into a display region of the fluorescent display device leads to a failure in display.

SUMMARY OF THE INVENTION

The present invention has been made in view of the foregoing disadvantage of the prior art.

Accordingly, it is an object of the present invention to provide a core wire for a filament or a filament core wire which is capable of being satisfactorily mounted while ensuring application of tension at a predetermined level thereto without using any expensive anchor and without applying unnecessary tension thereto.

It is another object of the present invention to provide a core wire for a filament or a filament core wire which is capable of attaining automation of production thereof.

It is a further object of the present invention to provide a filament core wire which is capable of being accommodated to an ultrathin fluorescent display device.

It is still another object of the present invention to provide a filament including such a filament core wire.

It is yet another object of the present invention to provide a method for mounting such a filament.

It is a still further object of the present invention to provide a fluorescent display device having such filaments incorporated therein.

In accordance with one aspect of the present invention, a core wire for a filament or a filament core wire is provided. The filament core wire includes a wire body provided at a part thereof with at least a spring section and a heat-decomposable block element arranged so as to cover the spring section while applying tension to the spring section.

In accordance with another aspect of the present invention, a filament is provided. The filament includes a filament core wire including a spring section provided thereon in proximity to at least one end thereof and at least a welded section arranged outside the spring section. The spring section is covered with a heat-decomposable block element arranged while applying tension to the spring section. The filament core wire has an electron emitting material deposited on a surface of a portion thereof which is not covered with the block element. The filament core wire is mounted on a mounting position by fixing it to a fixing spot of the mounting position.

In accordance with a further aspect of the present invention, a method for mounting a filament is provided. The method includes the step of mounting a filament on a mounting position. The filament is constituted by a filament core wire including a spring section provided thereon in proximity to at least one end thereof and at least a welded section arranged outside the spring section. The spring section is covered with a heat-decomposable block element arranged while applying tension to the spring section. The filament core wire has an electron emitting material deposited on a surface of a portion thereof which is not covered with the block element. The method further includes the step of fixing the welded section to a fixing spot of the mounting position.

In accordance with still another object of the present invention, a fluorescent display device for carrying out desired display by impinging electrons emitted from a filament stretchedly arranged in a vacuum envelope on a phosphor is provided. The filament includes a filament core wire including a spring section provided thereon in proximity to at least one end thereof and at least a welded section arranged outside the spring section. The spring section is covered with a heat-decomposable block element arranged while applying tension to the spring section. The filament core wire has an electron emitting material deposited on a surface of a portion thereof which is not covered with the block element. The filament core wire is mounted on a mounting position by fixing the welded section to a fixing spot of the mounting position. The block element of the spring section is removed therefrom by heating to keep tension in the spring section.

In accordance with a still further aspect of the present invention, a method for manufacturing a fluorescent display device for carrying out desired display by impinging electrons emitted from a filament stretchedly arranged in a vacuum envelope on a phosphor is provided. The method includes the steps of forming a filament core wire of the filament with a spring section so as to be positioned in proximity to at least one end thereof, covering at least the spring section with a heat-decomposable block element while applying tension to the spring section, depositing an electron emitting material on a surface of a portion of the filament core wire which is not covered with the block element, fixing the welded section to a fixing spot of a mounting position, and heating the envelope in which the filament fixed to the fixing spot of the mounting position is received to seal and evacuate the envelope and remove the block element of the spring section therefrom by heating.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein.

DETAILED DESCRIPTION OF THE PREFERRED EMBODIMENTS

Figure 1A:
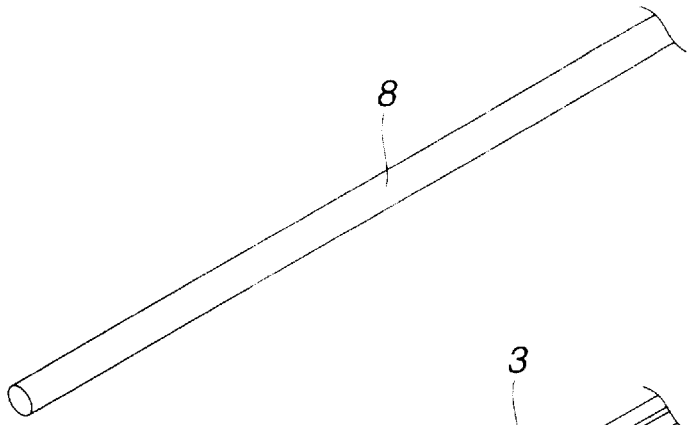
FIGS. 1(*a*) to 1(*d*) each are a perspective view showing each of steps in manufacturing of a filament core wire according to the present invention.
Figure 1B:
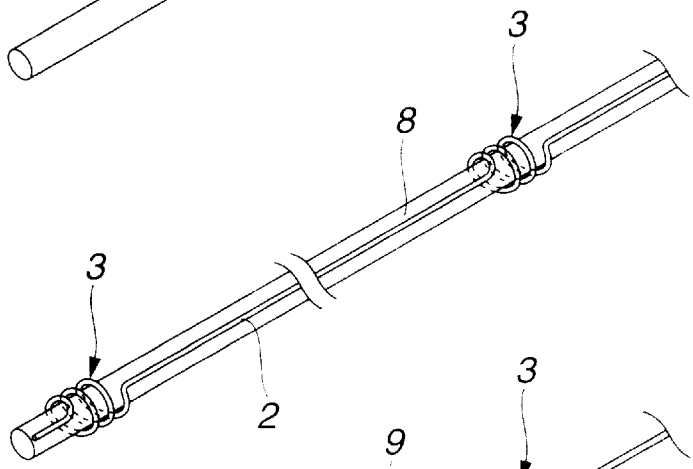
Figure 1C:
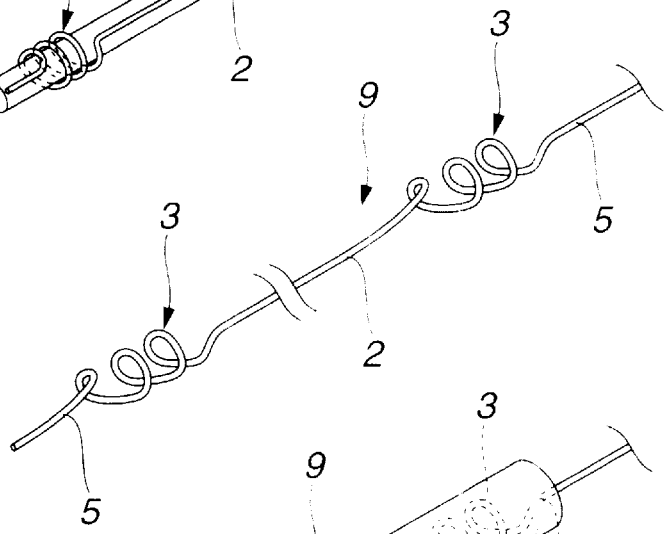
Figure 1D:
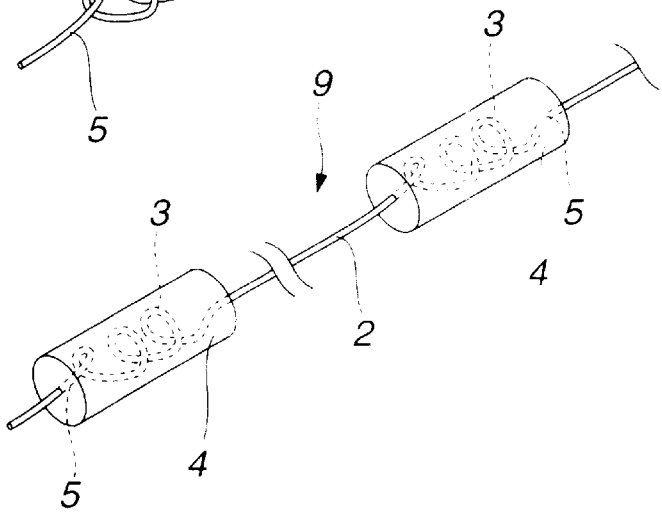

Now, the present invention will be described with reference to FIGS. 1(*a*) to 5.

A fluorescent display device according to the present invention may be configured in substantially the same manner as that described above with reference to FIGS. 6 and 7, except filaments.

A core wire for a filament or a filament core wire according to the present invention which is generally designated at reference numeral 1 in FIGS. 1(*a*) to 5 includes a wire body 2 made from, for example, a continuous wire material of tungsten wound in a roll-like manner. The wire body 2 is provided with coiled or corrugated spring sections 3 at predetermined intervals. The filament core wire 1 also includes a heat-decomposable block element 4 fixed on each of the spring sections 3 so as to cover each of the spring sections 3 and each of welded sections 5 while keeping tension applied to the spring section 3. The wire body 2 has an electron emitting material 6 deposited on a portion thereof except the portion thereof covered with the heat-decomposable block elements 4.

Mounting of the filament core wire 1 is carried out by locating the core wire 1 on a mounting position and removing each of the block elements 4 therefrom by heating. Then, the welded sections 5 of the wire body 2 each are fixed to a fixing spot of the mounting position and then the wire body 2 is cut in a predetermined length. This permits mounting of the filament core wire 1 to be carried out in a successive or continuous manner. The thus-mounted filament core wire 1 provides a filament 7 which is stretchedly arranged at the mounting position while exhibiting elasticity sufficient to keep tension applied thereto.

Now, manufacturing of the filament core wire 1 and filament 7, as well as mounting thereof will be described with reference to FIGS. 1(*a*) to 5.

First of all, a continuous tungsten wire 2 of 20 to 30 microns in diameter is wound on a molybdenum core wire material 8 which acts as a substrate in manufacturing of the filament core wire 1. The tungsten wire 2 may be made of tungsten alloy such as rhenium-tungsten alloy or the like so that spring sections 3 may be formed at predetermined intervals as shown in FIG. 1(*b*). In the illustrated embodiment, the spring sections 3 each may be formed into a coiled configuration.

The spring sections 3 may be arranged at intervals sufficient to permit each of the spring sections 3 to cover at least a width of each of display regions and formed into a length of several millimeters, for example, when the filament is mounted in a fluorescent display device. Thus, the spring sections 3 are arranged at intervals of covering at least a width of each of the display regions to which electrons are emitted.

Then, the molybdenum core wire 8 on which the tungsten wire 2 is wound is dissolved by an etching solution obtained by diluting a mixed acid to a concentration of 50% with water. The mixed acid is prepared by mixing nitric acid and sulfuric acid with each other at a ratio of 3:7. After the dissolution, the tungsten wire 2 is rinsed with water, resulting in such a coiled filament core wire 9 as shown in FIG. 1(*c*) being provided.

Figure 2:
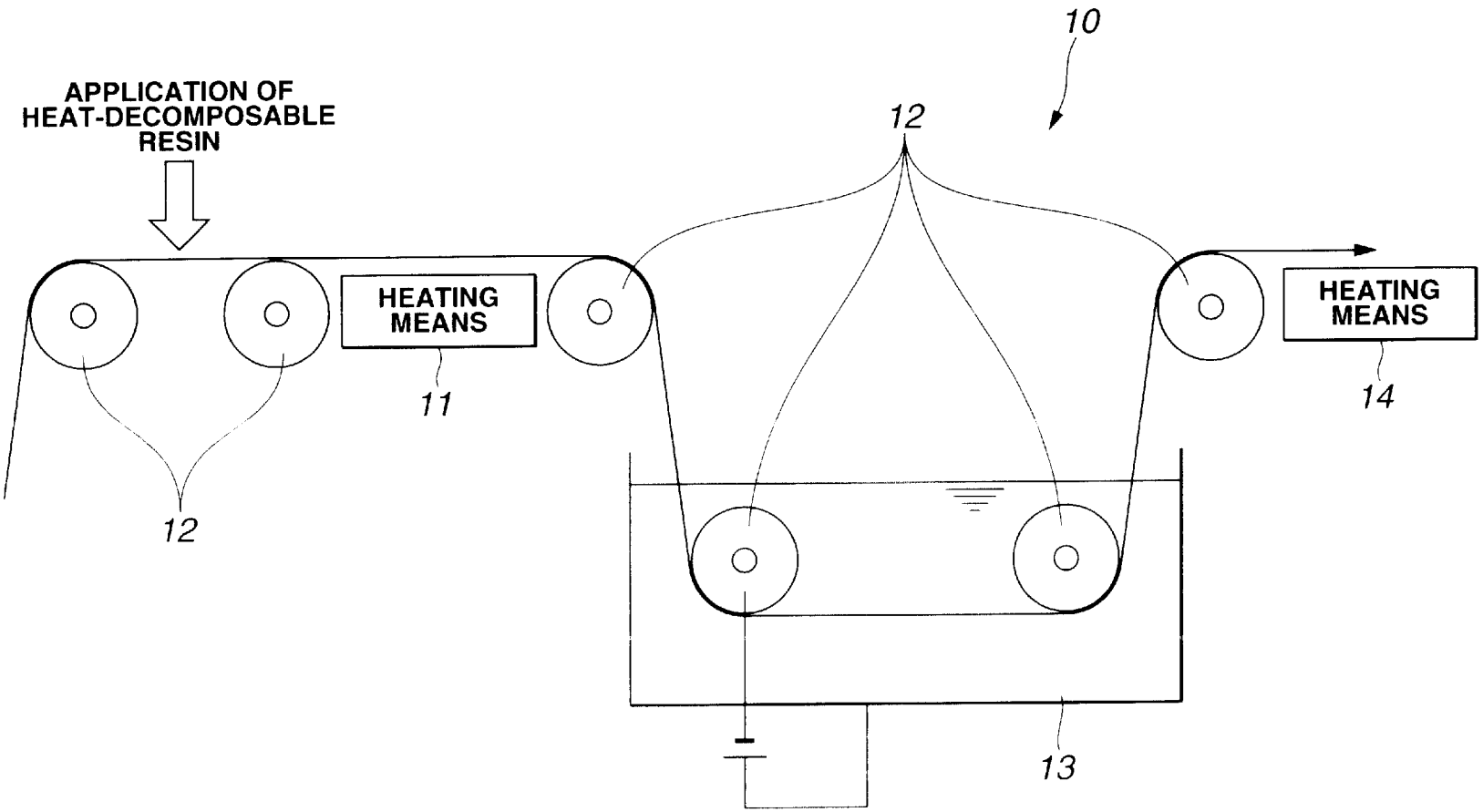
FIG. 2 is a schematic view showing an apparatus used in manufacturing of a filament according to the present invention by way of example.

The thus-provided coiled filament core wire 9 of a continuous length is subsequently subjected to a treatment using a treating apparatus 10 shown in FIG. 2.

First, as shown in FIG. 1(*d*), a heat-decomposable resin material is coated on the spring sections 3 and welded sections 5 of the coiled filament core wire 9 from which molybdenum (molybdenum core wire 8) has been removed by dissolution, resulting in the block elements 4 of, for example, 70 to 80 $\mu$m in diameter being formed thereon. When the filament is mounted in a fluorescent display device, the spring sections 3 and welded sections 5 correspond to portions of the fluorescent display device opposite to non-display regions thereof. The block elements 4 may be formed into a column-like shape. Thus, the block elements 4 each are formed so as to extend over each of the spring sections 3 of the coiled filament core wire 9 and outwardly extend from the spring section 3, to thereby cover each of the spring sections 3 and each of the welded sections 5.

The block elements 4 are not limited to such a column-like shape as described above. Thus, the block elements 4 may be formed into any other suitable configuration so long as they effectively cover the spring sections 3 and welded sections 5 of the coiled filament core wire 9 and are readily removed by heating in the subsequent step. The heat-decomposable resins include organic binders of acrylic resin, nitrocellulose and the like. Coating of the heat-decomposable resin is carried out while applying load at a suitable magnitude to each of the spring sections 3 to keep it elongated. Coating of the heat-decomposable resin may be practiced by potting techniques of dropping heat-decomposable resin kept molten, any suitable coating techniques such as brush coating or roll coating, spraying, or the like.

After formation of the block elements 4 by coating of the heat-decomposable resin, the coiled filament core wire 9 is heated to a temperature of about 150 to 200° C. using any suitable heating means 11 such as a heater or the like, resulting in being dried. This permits solidification of the block elements formed of the heat-decomposable resin, so that the so-solidified block elements 4 ensures application of tension to the spring sections.

Then, the coiled filament core wire 9 of a continuous length wound in a roll-like manner is carried through a carrying unit 12 including a plurality of rollers, a belt conveyor and the like, to thereby be subjected to electro-deposition processing. In the electro-deposition processing, the coiled filament core wire 9 is continuously introduced into an electro-depositing bath 13, resulting in the carbonate or electron emitting material 6 being electro-deposited on the coiled filament core wire 9. During deposition of the carbonate 6, the portions of the coiled filament core wire 9 covered with the block elements 4 each are prevented from direct deposition of the carbonate 6 thereon, because the block elements 4 each act as a deposition mask.

After such electro-deposition of the carbonate 6, the coiled filament core wire 9 is dried using a heater 14 acting as a heating means. A temperature at which the coiled filament core wire 9 is heated is set to be within a range which prevents evaporation of the block elements 4 made of the heat-decomposable material. For example, acrylic resin is used as the heat-decomposable resin, the heating temperature is generally set at a level of 200° C. or below.

Figure 3:
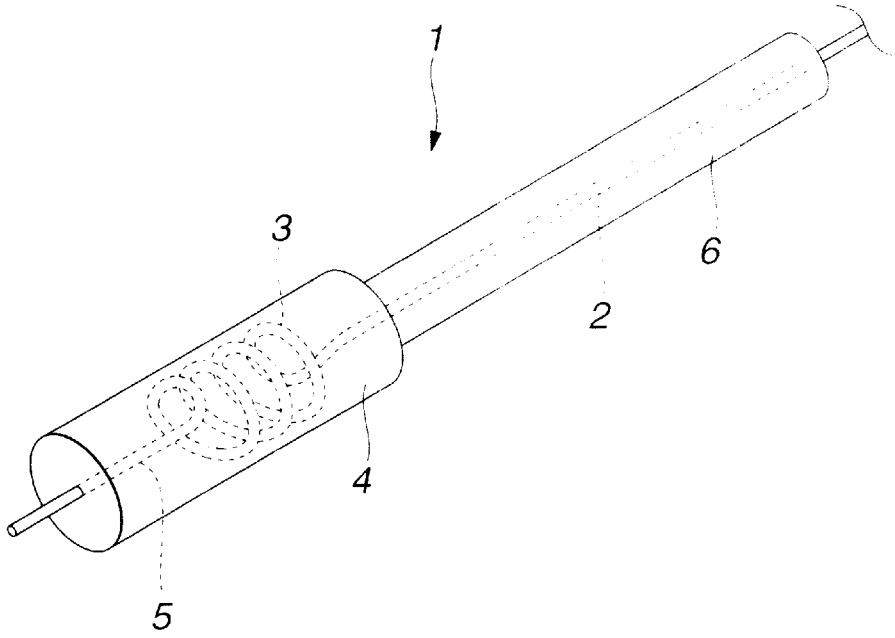
FIG. 3 is a fragmentary enlarged perspective view showing a filament according to the present invention.

This provides the filament core wire 1 having the carbonate 6 electro-deposited on the portion thereof except the spring sections 3 and welded sections 5, as shown in FIG. 3. The thus-obtained filament core wire 1 is then wound in, for example, a roll-like manner. Then, the filament core wire 1 is drawn out at one end thereof to a mounting position while being kept in the form of a continuous length. Subsequently, the block element 4 covering each of the welded sections 5 is removed, followed by welding of the welded section 5 to a fixing spot of the mounting position. Thereafter, the filament core wire 1 is cut in a predetermined length and then the block element 4 covering each of the spring sections 3 is removed.

The welding is carried out by locally heating only the welded sections 5 made of the heat-decomposable resin to a temperature which causes evaporation of the sections 5. When acrylic resin is used as the heat-decomposable resin, the welded sections 5 are heated to a temperature of 300° C. or more because acrylic resin starts to be melted at about 250° C. Such local heating may be executed by any suitable heating techniques such as laser heating, lamp heating, micro-burner heating, resistance heating or the like.

When the block elements 4 made of the heat-decomposable resin is thus removed by evaporation, the welded sections 5 of the filament core wire 1 are exposed, so that the welded sections 5 may be directly welded to a metal material arranged at the fixed spot of the mounting position. The block element 4 which is formed so as to cover each of the spring sections 3 is removed after fixing of the welded section on the mounting position, to thereby permit the spring section 3 to exert restoring force, resulting in the spring section 3 exhibiting desired elasticity.

Now, mounting of the thus-obtained filament core wire 1 in a fluorescent display device will be described with reference to FIGS. 4 and 5 by way of example.

Figure 4:
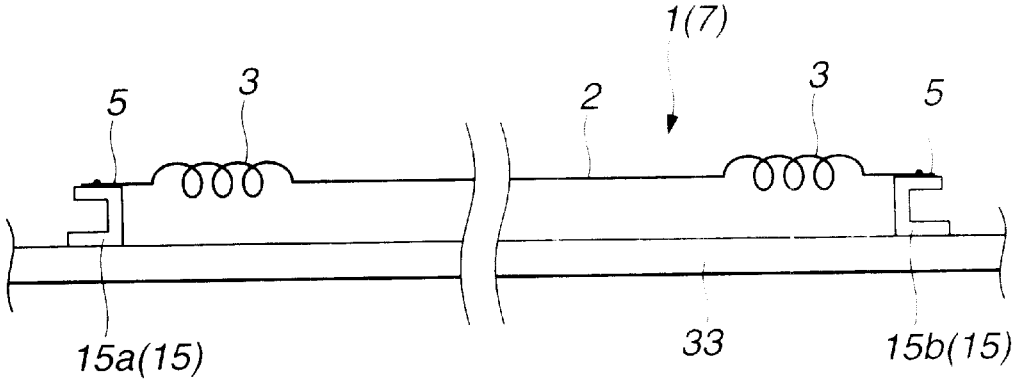
FIG. 4 is a schematic view showing a manner of mounting of a filament according to the present invention by way of example.

In FIG. 4, a pair of supports 15 (15*a*, 15*b*) acting as a fixing and stretching member are provided on an anode substrate 33. The filament core wire 1 of a continuous length drawn out at one end thereof is arranged so as to extend between the supports 15*a* and 15*b*. Then, only the welded sections 5 of the filament core wire 1 are heated to remove the block elements 4 therefrom. Subsequently, the welded sections 5 are welded to the supports 15*a* and 15*b* and then the filament core wire 1 is cut in a predetermined length. Thereafter, the block sections 4 covering the spring sections 3 are removed therefrom by heating carried out during a sealing step and/or an evacuating step in manufacturing of the fluorescent display device. This permits the filament 7 to be stretchedly arranged between the supports 15*a* and 15*b* each of which act as a mounting position while keeping tension at a predetermined magnitude applied thereto.

The above-described construction of the illustrated embodiment permits stretched arrangement of the filament 7 without using any expensive anchor while supporting both ends thereof on the supports 15*a* and 15*b* each acting as the fixing and stretching member. This results in stretched arrangement of the filament 7 being continuously carried out during manufacturing of the fluorescent display device, to thereby accomplish automation of the manufacturing.

Figure 5:
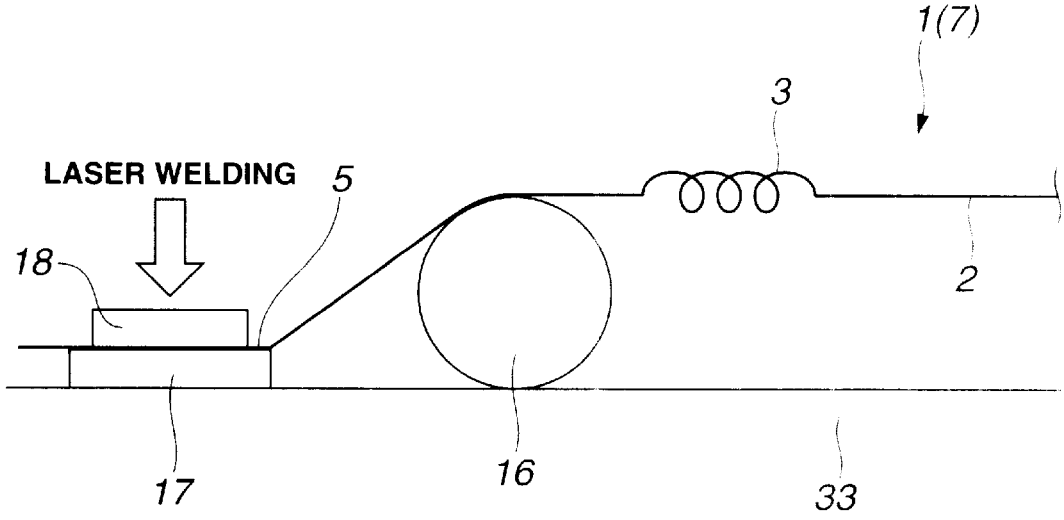
FIG. 5 is a schematic view showing another example of a manner of mounting of a filament according to the present invention.

In FIG. 5, a pair of spacer members 16 each constituted by a round rod made of, for example, glass fiber, ceramic or the like are arranged on the anode substrate 33. In FIG. 5, only one of the spacer members is illustrated for the sake of brevity. The filament core wire 1 of a continuous length is drawn out at one end thereof and arranged so as to extend between wiring layers 17 for driving of filament and between the spacer members 16. The filament driving wiring layers 17 may be depositedly formed on both sides of a position at which the filament is arranged by, for example, sputtering. The wiring layers 17 may be deposited in the form of a thin Al film of a thickness as small as about 1 to 2 $\mu$m. Then, only the welded sections 5 of the filament core wire 1 are heated for the purpose of removing the block elements 4 therefrom. Then, a metal foil 18 made of Al or the like is positioned on the welded section 5 of the filament core wire 1 arranged on each of the wiring layers 17 and then the each of the welded sections 5 is welded to each of the wiring layer 17 through the metal foil 18. The welding may be executed by, for example, laser welding, ultrasonic bonding or the like. Then, the filament core wire 1 is cut in a predetermined length. Thereafter, the block elements 4 are removed from the spring sections 3 by calcination carried out in a sealing step and/or an evacuating step, so that the filament 7 may be stretchedly arranged at a mounting position or so as to extend through the spacers 16 between the wiring layers 17 while keeping tension at a predetermined magnitude applied thereto.

In FIG. 5, the filament core wire 1 is welded between the wiring layers 17 and the metal foils 18 on the anode substrate 33. Alternatively, the mounting of FIG. 5 may be modified in such a manner that a metal plate is arranged on the wiring layer on the anode substrate and welding of the filament core wire is carried out directly or through the metal foil.

Also, the mounting of FIG. 5 may be carried out so that a metal wire is welded to each of the wiring layers 17 on the anode substrate 33 by ultrasonic wire bonding, to thereby securely interpose the filament between the wiring layer 17 and the metal wire.

Further, it may be carried out in such a manner that a metal layer made of a thin Al film or the like is previously partially deposited on each of the welded sections 5 of the filament core wire 1 and then welded to each of the wiring layers 17 on the anode substrate 33 by ultrasonic bonding, resulting in the filament being securely interposed between the wiring layer 17 and the metal layer of the filament core wire 1.

In each of FIGS. 4 and 5, after the heat-decomposable block element 4 is formed on each of the welded sections 5 of the filament core wire 1 and then removed therefrom, the welded section 5 is welded to the fixing spot of the mounting position. Alternatively, the welded section 5 may be fixed to the fixing spot of the mounting position while depositing the electron emitting material 6 on the welded section 5 rather than formation of the block element 4 on the welded section 5 of the filament core wire 1. Thus, it is merely required to cover at least the spring sections 3 of the filament core wire 1 with the heat-decomposable block elements 4.

Such construction permits stretched arrangement of the filament to be carried out using glass fiber or the like for the spacer member rather use of an expensive anchor, resulting in the arrangement continuously taking place, so that automation thereof may be accomplished.

The above-described mounting of the filament core wire 1 in the fluorescent display device permits the heat-decomposable block element 4 adhered to each of the spring sections 3 to be evaporated in the sealing step and/or evacuating step, because a calcination temperature in the sealing step is about 500° C. and that in the evacuating step is about 350° C. This permits the filament core wire 1 to be provided with desired elasticity due to restoring force of the spring sections 3, so that tension at a predetermined magnitude may be kept applied to the filament 7. Also, acrylic resin is used as the heat-decomposable resin, it is not required to apply unnecessary or extra tension to the filament during welding of the filament, because acrylic resin starts to be melted at a temperature of about 250, to thereby be removed in the sealing step and/or evacuating step.

When the sealing step and evacuating step are carried out separate from each other and a sealed portion of the fluorescent display device is sealed by local heating using laser or the like, the acrylic resin may be removed by evaporation in the evacuating step rather than the sealing step.

Thus, in the illustrated embodiment, the molybdenum core wire 8 has the tungsten wire 2 wound thereon while being formed with the spring sections at predetermined intervals and then only the core wire 8 is dissolved, followed by rinsing of the tungsten wire 2. Then, the block element 4 is formed on each of the spring sections 3 and welded sections 5 while keeping tension applied to the spring sections 3 of the tungsten wire 2. Thereafter, the carbonate 6 is electro-deposited on the tungsten wire 2, to thereby provide the filament core wire 1.

Then, the thus-formed filament core wire 1 is mounted in the fluorescent display device. More particularly, the filament core wire 1 is arranged at the mounting position of the fluorescent display device and then only the welded sections 5 are heated to remove the heat-decomposable block elements 4 therefrom. Then, the welded sections 5 each are fixed to the fixing spot of the mounting position and the filament core wire 1 is cut in a predetermined length. Thereafter, calcination carried out in the sealing step and/or evacuating step permits the block elements 4 to be removed from the spring sections 3. This results in the filament 7 being stretchedly arranged at the mounting position while keeping tension at a predetermined magnitude applied thereto.

Thus, in the illustrated embodiment, the heat-decomposable block element 4 made of, for example, acrylic resin or nitrocellulose is formed on each of the spring sections and welded sections to mask it and then the carbonate 6 is electro-deposited on the core wire 2. This results in tension at a sufficient level being applied to the filament. Thus, the filament may be mounted in the fluorescent display device while keeping tension at a desired level applied thereto without requiring such an expensive anchor as used in the prior art. In addition, it permits continuous electro-deposition of the carbonate as in the prior art, so that a series of operations from manufacturing of the filament core wire 1 to mounting of the filament 7 may be continuously carried out, leading to automation of the manufacturing and mounting.

Also, when the block element 4 acting as a mask is made of acrylic resin, it exhibits fixing force at a sufficient level in mounting of the filament in the fluorescent display device and is fully removed in the sealing step and/or evacuating step, because the acrylic resin is evaporated at a temperature as low as about 300° C.

The spring sections 3 each are formed thereon with the block element 4 by coating acrylic resin thereon while applying tension thereto and kept covered with the block element 4 until the welded section is fixed to the fixing spot of the mounting position. This eliminates a necessity of applying unnecessary or extra tension to the spring section 3 during welding of the filament.

Masking of each of the spring sections 3 and welded sections 5 with the block element 4 during electro-deposition of the carbonate 6 effectively prevents adhesion of any unnecessary oxide thereto and eliminates a necessity of removing the oxide therefrom during the welding, to thereby simplify the operation. A fluorescent display device inherently causes an end cool phenomenon which causes both ends of a filament to be reduced in temperature. The spring section 3 and welded section 5 which correspond to such end-cooled portion of the filament each are covered with the block element 4, resulting in electro-deposition of the carbonate 6 thereon being prevented. This prevents electro-deposition of the carbonate to the portion of the filament which does not require the deposition. This permits electrons to be emitted from a portion of the filament 7 other than the spring section 3 and welded section 5 (end-cooled portions), so that electrons may be emitted from only a minimum region of the filament which contributes to display.

Figure 6:
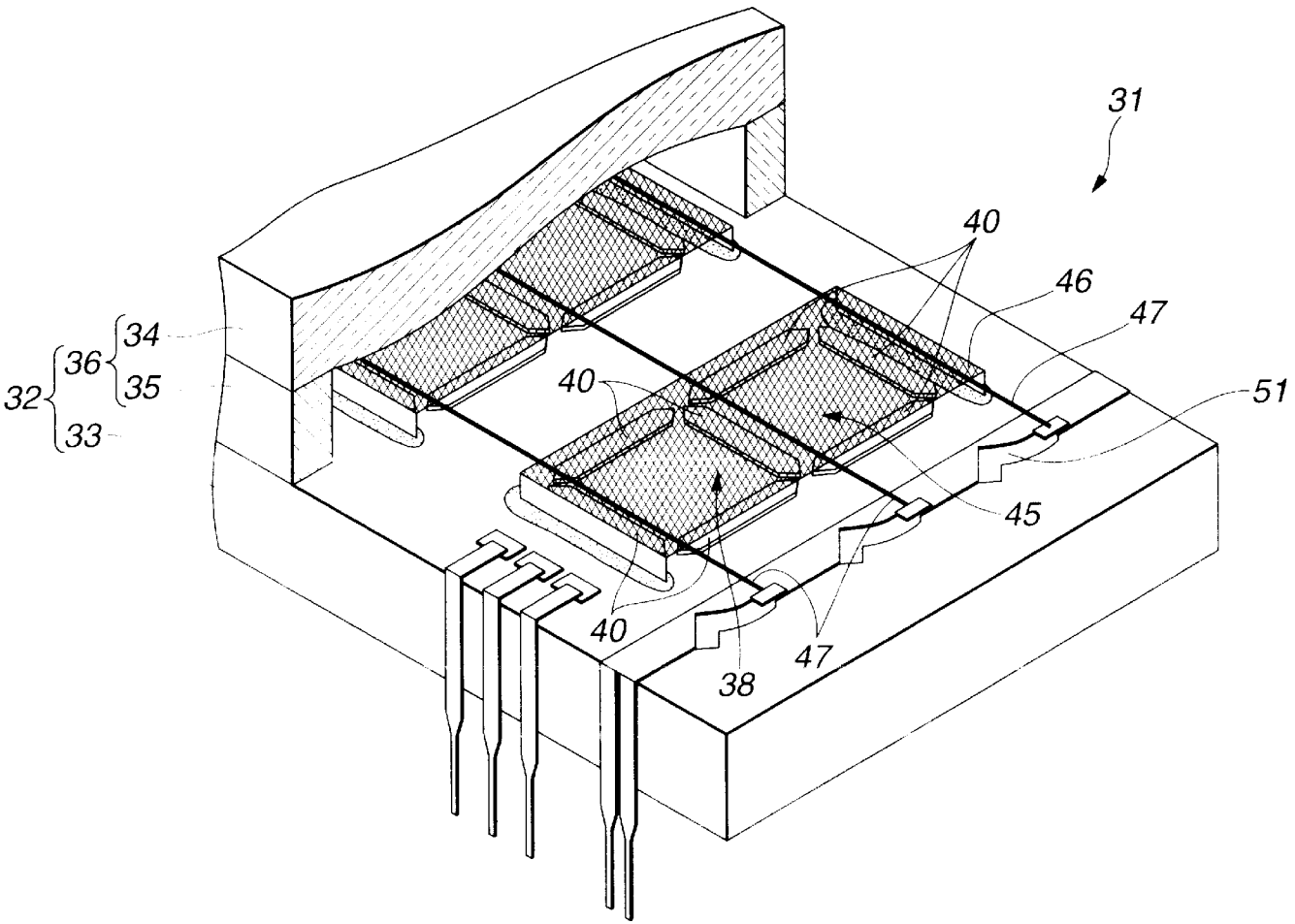
FIG.6 (PRIOR ART)
FIG. 6 is a partially cutaway perspective view showing a general structure of a conventional fluorescent display device which has been generally known in the art.
Figure 7:
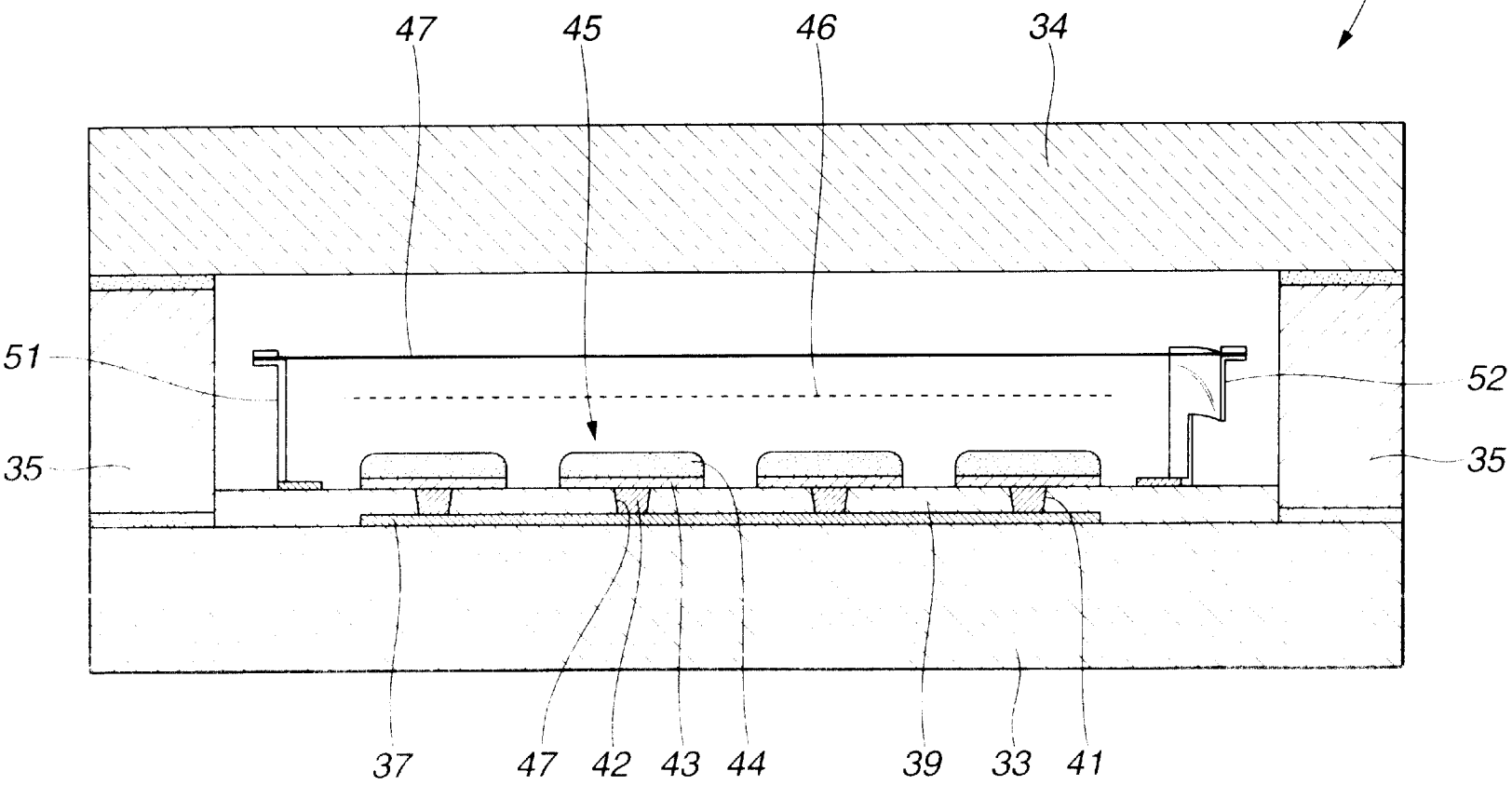
FIG.7 (PRIOR ART)
FIG. 7 is a fragmentary enlarged sectional view of the fluorescent display device shown in FIG. 6.
Figure 8:
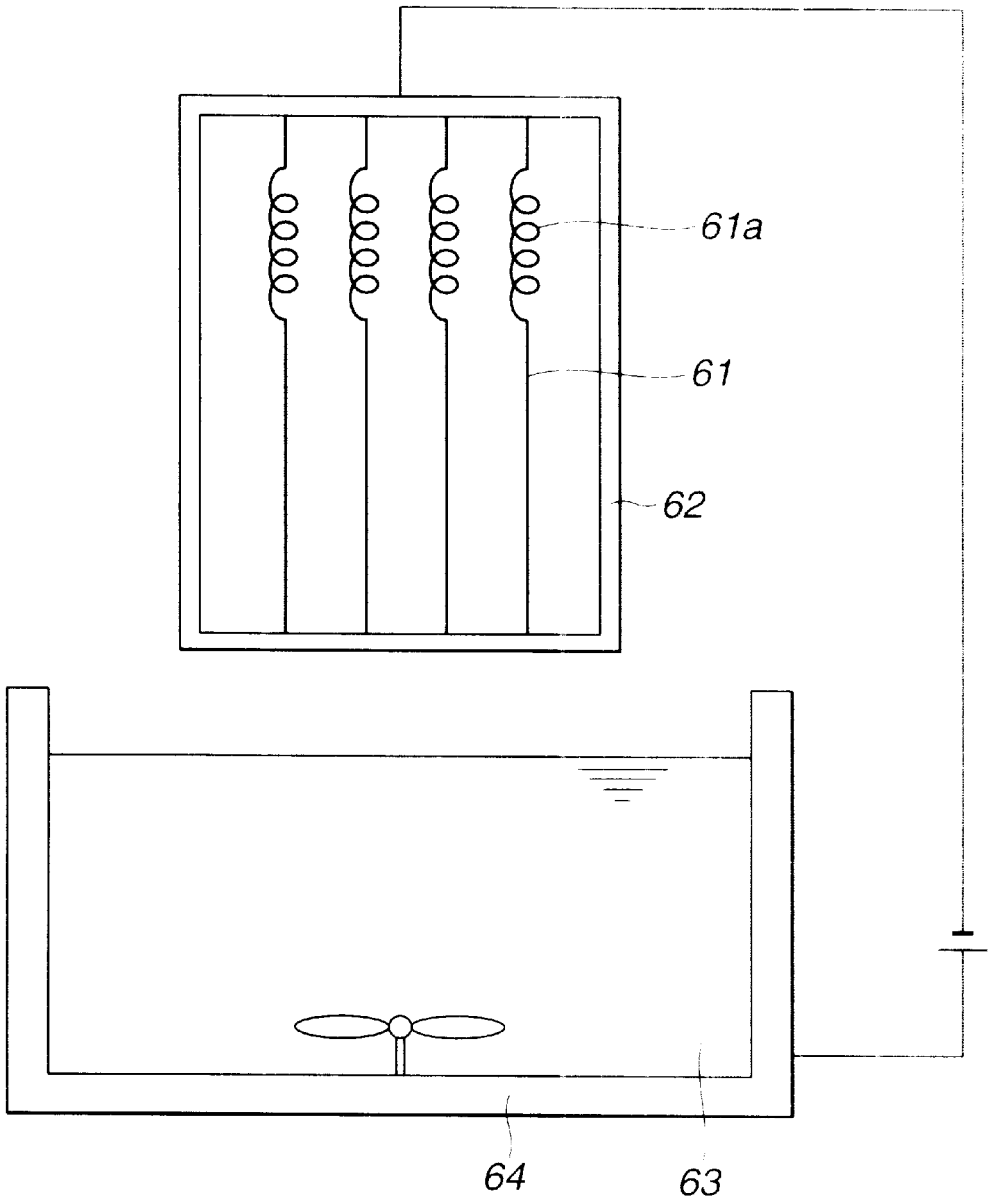
FIG.8 (PRIOR ART)
FIG. 8 is a schematic view showing an apparatus used in manufacturing of a conventional coiled filament.

A device in which the filament of the illustrated embodiment is mounted is not limited to the fluorescent display device 31 shown in FIG. 6. It may be mounted in any other device so long as it uses an electron source which emits thermions.

As can be seen from the foregoing, the filament of the present invention has the heat-decomposable block element formed on each of the spring and welded sections of the filament core wire to cover it therewith and has the electron emitting material electro-deposited on a surface of the core sire. This permits tension at a sufficient level to be applied to the filament, to thereby carry out mounting of the filament while keeping tension therein without an expensive anchor used in the prior art. Also, it permits electro-deposition of the carbonate to be continuously carried out as in the prior art, resulting in a series of operations from manufacturing of the filament to mounting thereof being automatically continuously accomplished.

The heat-decomposable block element which acts as a mask for the spring and welded sections during electro-deposition of the carbonate on the core wire may be fully removed therefrom, for example, in the sealing step and/or evacuating step in manufacturing of the fluorescent display device.

Also, the block element is formed so as to cover each of the spring and welded sections while previously applying tension to the spring section and then the block element on the welded section is removed therefrom by heating during welding thereof. This eliminates a necessity of applying tension to the filament during the welding, to thereby simplify manufacturing of the filament, leading to a reduction in manufacturing cost.

Masking of each of the spring and welded sections with the block element during electro-deposition of the electron emitting material effectively prevents adhesion of any unnecessary oxide thereto and eliminates a necessity of removing the oxide therefrom during the welding operation, to thereby simplify the operation. Also, the filament is constructed so as to emit electrons from the portion thereof other than the spring and welded sections, to thereby avoid emission of electrons from the unnecessary portion of the filament corresponding to the end-cooled portions thereof, so that electrons may be emitted from only a minimum portion of the filament which contributes to display. Further, such construction prevents decomposition and scattering of the carbonate adhered to the spring sections, to thereby avoid adhesion of the thus-scattered carbonate to the phosphor, to thereby eliminate a failure in display and minimize a reduction in vacuum in the envelope.

While preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A core wire for a filament, comprising:

a wire body provided at a part thereof with at least a spring section; and a heat-decomposable block element arranged so as to cover said spring section while applying tension to said spring section.

2. A filament comprising:

a filament core wire including a spring section provided thereon in proximity to at least one end thereof and at least a welded section arranged outside said spring section;

said spring section being covered with a heat-decomposable block element arranged while applying tension to said spring section;

said filament core wire having an electron emitting material deposited on a surface of a portion thereof which is not covered with said block element;

said filament core wire being mounted on a mounting position by fixing it to a fixing spot of the mounting position.

3. A method for mounting a filament, comprising the steps of:

mounting a filament on a mounting position;

said filament being constituted by a filament core wire including a spring section provided thereon in proximity to at least one end thereof and at least a welded section arranged outside said spring section;

said spring section being covered with a heat-decomposable block element arranged while applying tension to said spring section;

said filament core wire having an electron emitting material deposited on a surface of a portion thereof which is not covered with said block element; and fixing said welded section to a fixing spot of said mounting position.

4. A fluorescent display device for carrying out desired display by impinging electrons emitted from a filament stretchedly arranged in a vacuum envelope on a phosphor, wherein:

said filament comprises a filament core wire including a spring section provided thereon in proximity to at least one end thereof and at least a welded section arranged outside said spring section;

said spring section being covered with a heat-decomposable block element arranged while applying tension to said spring section;

said filament core wire having an electron emitting material deposited on a surface of a portion thereof which is not covered with said block element;

said filament core wire being mounted on a mounting position by fixing said welded section to a fixing spot of the mounting position;

said block element of said spring section being removed therefrom by heating to keep tension in said spring section.

5. A method for manufacturing a fluorescent display device for carrying out desired display by impinging electrons emitted from a filament stretchedly arranged in a vacuum envelope on a phosphor, comprising the steps of:

forming a filament core wire of said filament with a spring section so as to be positioned in proximity to at least one end thereof;

covering at least said spring section with a heat-decomposable block element while applying tension to said spring section;

depositing an electron emitting material on a surface of a portion of said filament core wire which is not covered with said block element;

fixing said welded section to a fixing spot of a mounting position; and heating the envelope in which said filament fixed to the fixing spot of the mounting position is received to seal and evacuate the envelope and remove said block element of said spring section therefrom by heating.

* * * * *